United States Patent [19]

Heath

[11] 4,123,977

[45] Nov. 7, 1978

[54] PORTABLE AND CONVERTIBLE WASHSTAND

[76] Inventor: Roderick C. Heath, 6404 Greengate Hill Rd., Fayetteville, N.C. 28303

[21] Appl. No.: 858,073

[22] Filed: Dec. 6, 1977

[51] Int. Cl.[2] ..... A47B 85/00

[52] U.S. Cl. ..... 108/25; 108/33; 312/228; 312/231

[58] Field of Search ..... 108/25, 33, 34; 302/228, 231; 4/167

[56] References Cited

U.S. PATENT DOCUMENTS

| | | | |
|---|---|---|---|
| 2,520,543 | 8/1950 | Hawkins | 108/25 X |
| 2,609,072 | 9/1952 | Levinson | 108/33 X |
| 2,903,311 | 9/1959 | Earhart | 108/34 |
| 3,181,483 | 5/1965 | DeVitt et al. | 108/25 |
| 3,208,409 | 9/1965 | Gale | 108/25 X |
| 3,244,451 | 4/1966 | Roy | 108/34 X |

FOREIGN PATENT DOCUMENTS

| | | | |
|---|---|---|---|
| 1,345,997 | 11/1963 | France | 108/33 |
| 228,934 | 11/1910 | Fed. Rep. of Germany | 108/25 |

*Primary Examiner*—Roy D. Frazier
*Assistant Examiner*—Peter A. Aschenbrenner
*Attorney, Agent, or Firm*—J. Gibson Semmes

[57] ABSTRACT

Portable and convertible washstand characterized by the nestable relationship of the basic elements, the stand being adapted to tripod support and having at least two utility shelves, adapted to fabrication from essentially rigid, lightweight, readily extruded materials.

3 Claims, 8 Drawing Figures

PORTABLE AND CONVERTIBLE WASHSTAND

BRIEF DESCRIPTION OF THE PRIOR ART

The invention is essentially a utility convenience for campers and those serving in official capacities in the outdoors such as the military, the various government agencies related to the outdoors. Its uniqueness resides in the extreme collapsible and portable nature, wherein a conveniently raised stand extending over three to four feet or more from the surface of the ground, can be reduced to a compact carrying unit of box-like construction. The best known art is represented by the following:

| | | | |
|---|---|---|---|
| 1,978,650 | Shannon | 3,186,780 | Schaerf |
| 2,411,332 | Orchard | 3,617,104 | Stadig |
| 2,575,537 | Trumfio | 3,687,092 | Manning |
| 2,610,761 | Fleming | 3,875,873 | Howitt |
| 2,944,862 | Heil | 3,923,356 | Washburne |

Whereas the art is highly developed in this field, no combination of the aforementioned patents suggests the hereinafter described and illustrated invention.

BRIEF DESCRIPTION OF PREFERRED EMBODIMENTS

Figure 1:
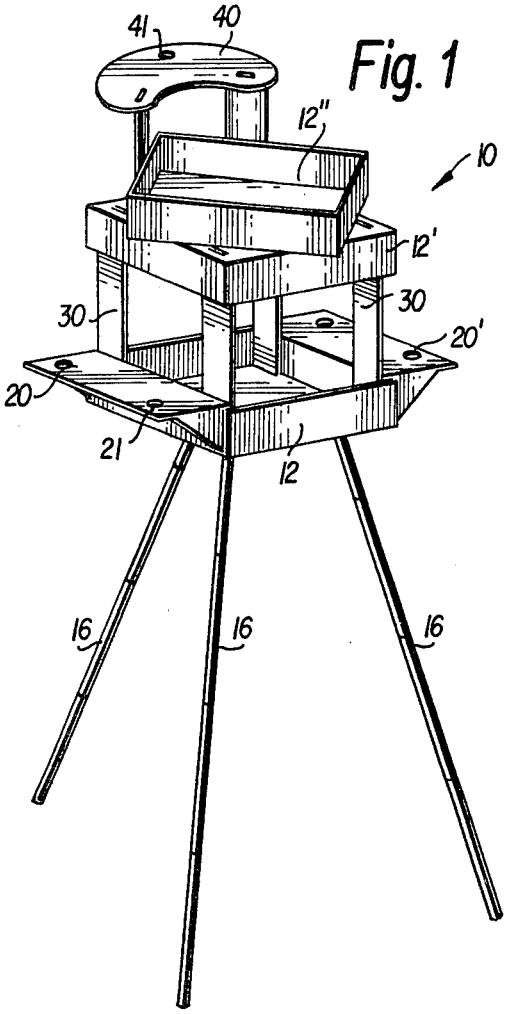
FIG. 1 is a view in perspective of invention in erected form.
Figure 2:
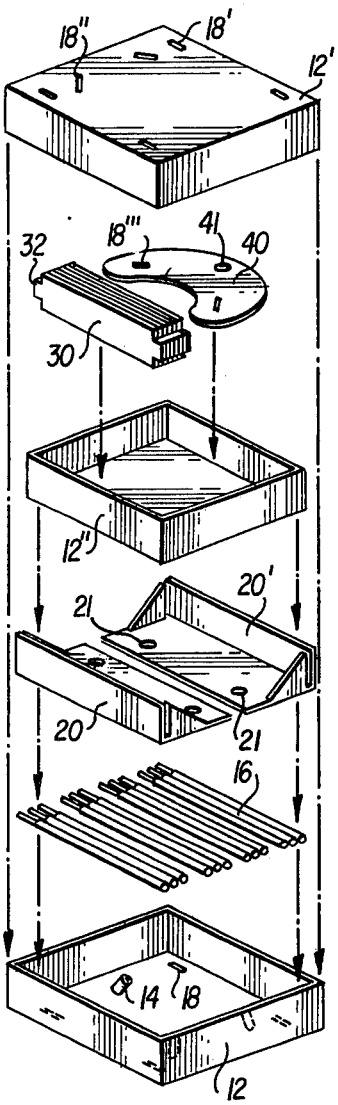
FIG. 2 is an exploded view of the components of the FIG. 1 concept of invention, such as may be collapsed and brought together to form a portable package.
Figure 3:
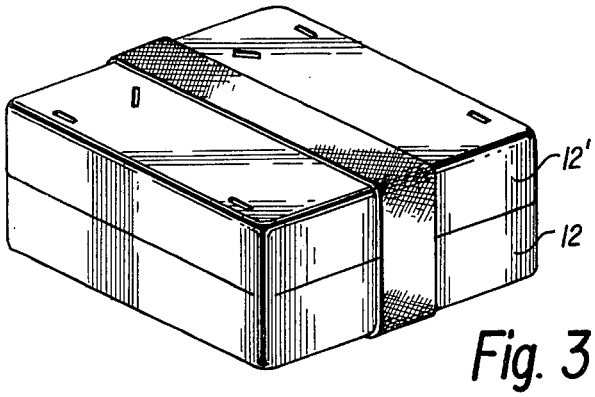
FIG. 3 is a view in perspective of a portable package of invention.

The invention, it will be noted from reference to FIGS. 1 and 2 and 3 relates to a portable stand, ideally suited for transport and assembly of toiletries, which is constructed of durable, lightweight, preferably injection molded synthetic plastic materials. It is designed to be broken down as in FIGS. 2 and 3 into a convenient package. The collapsible nature of the stand is such as to provide nestable components, all readily fitted into each other, resulting in the compact portable unit of FIG. 3.

More specifically, the portable stand 10 comprises a stand case 12, said case 12 having ports 14, sufficient in number to accommodate the tripod section 16. It will be noted that the stand case 12 also includes in its base portion, elongated apertures 18, said apertures being adapted to receive the extensions of the vertical supports 30 therein, as will be more fully explained hereinafter.

Referring again to FIG. 1, it will be noted that wing-shelves 20 may be adapted, in the form shown, to provide lateral extensions to the stand case 12, all of which may serve as a temporary container during outdoor usage. These winged shelves 20–20', having candelstick apertures 21, are shown inverted in the containerized exploded view of FIG. 2. In turn, the washbasin 12'' is adapted to seat itself between the respective inverted wing-shelves 20'' or 20' and the half moon mirror shelf 40, as well as the vertical supports 30 are adapted in the compacted configuration of FIGS. 2 and 3 to seat within the washbasin 12'', the entire being superposed by the cover member 12', reference FIG. 2.

Figure 4:
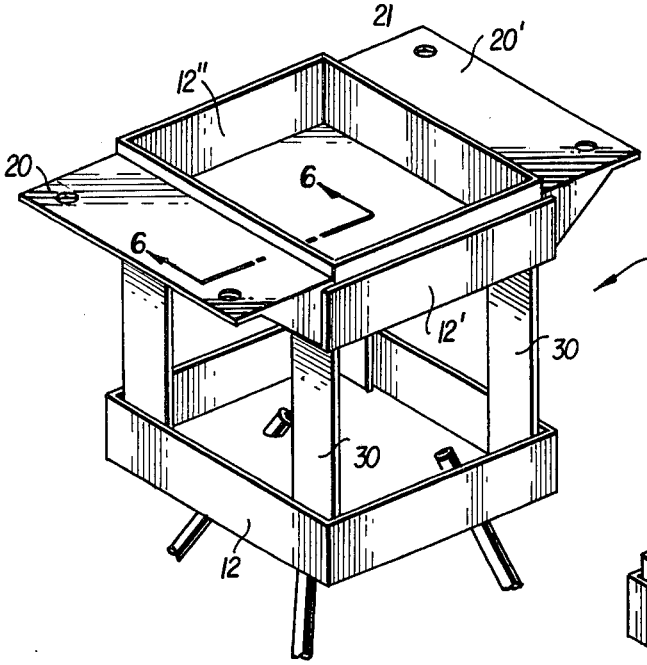
FIG. 4 is a fragmentary view in perspective of one modified form of construction.

A modified version of the washstand is shown in FIG. 4 wherein the stand case 12, having the plural vertical supports 30 connecting the receptacle 12' for a removal of the wing shelves 20'' or 20' to the upper level providing an approximate shelf to the seated washbasin 12''.

Figure 5:
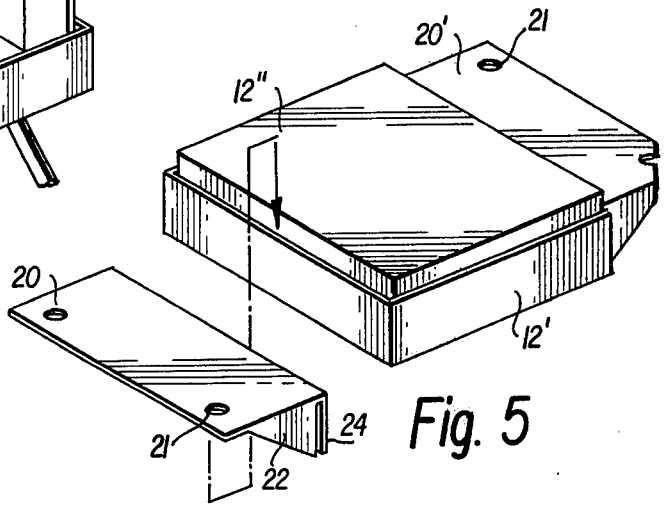
FIG. 5 illustrates the convertible mode of forming a modified table construction, reference FIG. 4.
Figure 6:
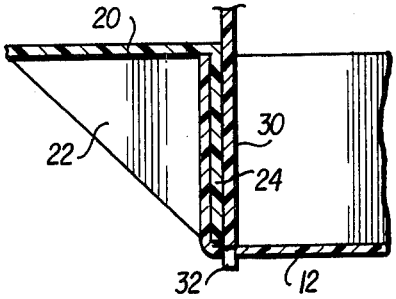
FIG. 6 illustrates in partial detail a section of the invention comprising wing shelf, stand case, and vertical support as illustrated in FIG. 1.

A further modification of the construction shown in FIG. 4, will be apparent from reference to FIG. 5 wherein the washbasin 12'' when overturned, provides together with the wing shelves 20'' or 20' a suitable desk for writing and the like. The remainder of the drawings show the interrelationship of the winged elements, 20, supporting elements 30, and receptacle portions 18 of the stand case.

Figure 7:
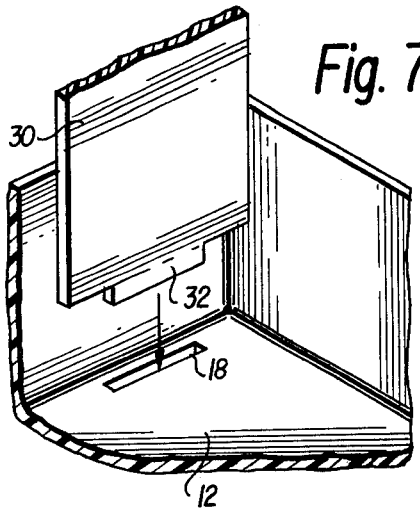
FIG. 7 is a view in perspective of a portion of the constructions represented by FIGS. 1 and 4.
Figure 8:
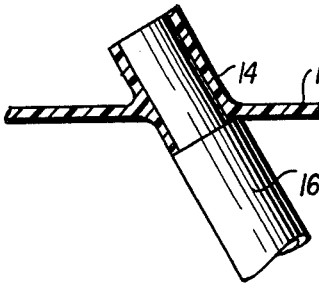
FIG. 8 is a view in section of a portion of the supporting stand case, most clearly shown in FIGS. 1 and 2.

It will thus be apparent from reference to FIGS. 1 and 7 that the vertical supports are adapted to friction-fit seating within the apertures provided in the stand case elements 12 and 12' whereupon as seated, a substantially rigid interconnection is made between those two stand case elements. And, too, by reason of the construction of the vertical supports 30 and the half moon mirror shelf 40, it can be seen that a substantially rigid, smaller mirror shelf is presented for the preferred utility of the washbasin 12' or 12'' in fitted relationship thereto, reference FIG. 1.

The mirror shelf 40, it will be noted is provided with a suitable aperture 41, serving as a candlestick repository.

From the foregoing, it will be apparent that various modifications to the invention may be made without departing from the spirit of the invention, as claimed. For example, the segments forming the tripod support may be increased or decreased in number to provide a washstand or desk of varying types and, too, whereas substantially rectangular nesting stand case and washbasin portions are illustrated, it will be obvious that other geometric forms may be utilized in connection with the vertical supports and accompanying wing shelves without departing further from the spirit of invention. All interlocking elements are suited to friction-fit contact, thus lending more stability than would otherwise be possible.

I claim:

1. Collapsible utility stand having nestable components, comprising:

(A) duplicate rectangular trays, said trays each having a flat bottom and upright sides which are connected to each other, the flat bottom of said trays each defining elongated and opposed apertures, one each of said apertures being disposed in the tray adjacent each corner thereof and spaced apart from a side of the tray;

(B) flat, tray supporting slats, each said slat having corresponding protrusions at opposite ends thereof, said protrusions being dimensioned to seat the slats in corresponding opposed apertures of the trays, to support the respective trays in superposition relative to each other;

(C) opposed shelves, each of said shelves comprising an elongated top, said top having adjacent the rear a dependent support and flange, spaced rearwardly from the support, both said flange and support engaging opposite sides of one of said trays in a frictional fit, the flange being set between an inner side of one of said trays and the slats to give rigidity to the stand;

(D) plural legs, detachably retained within the lower of said trays.

2. The apparatus according to claim 1, wherein the slats are elongate and rectangular, each said slat having rectangular protrusions at ends thereof, each said protrusion being of less width than the body thereof.

3. The collapsible utility stand of claim 2, further including a supplemental shelf, mounted in spaced, offset relation to the upper of said trays, said shelf defining plural, elongate support apertures therein and being interconnected with the upper said case by vertical slats, said apertures and said slats being disposed at an acute angle relative to each other and to walls of the corresponding support tray, whereby to give rigidity to the supplemental shelf.

* * * * *